US006038862A

United States Patent [19]

Melman et al.

[11] Patent Number: 6,038,862

[45] Date of Patent: Mar. 21, 2000

[54] VIBRATION DAMPER FOR A FUEL NOZZLE OF A GAS TURBINE ENGINE

[75] Inventors: Jeffrey D. Melman, Simsbury; Aaron S. Butler, Colchester, both of Conn.

[73] Assignee: United Technologies Corporation, Hartford, Conn.

[21] Appl. No.: 08/996,631

[22] Filed: Dec. 23, 1997

[51] Int. Cl.[7] ..... F02C 7/24

[52] U.S. Cl. ..... 60/740; 60/742; 60/725; 431/114

[58] Field of Search ..... 60/39.31, 39.32, 60/740, 742, 725; 431/114

[56] References Cited

U.S. PATENT DOCUMENTS

| | | | |
|---|---|---|---|
| 3,126,918 | 3/1964 | Eaton . | |
| 3,420,553 | 1/1969 | Poxon et al. . | |
| 3,785,407 | 1/1974 | Waite et al. . | |
| 4,033,381 | 7/1977 | Newman et al. . | |
| 4,098,476 | 7/1978 | Jutte et al. . | |
| 4,250,927 | 2/1981 | Newburg . | |
| 4,258,544 | 3/1981 | Gebhardt et al. | 60/742 |
| 4,350,372 | 9/1982 | Logsdon | 285/45 |
| 4,394,531 | 7/1983 | Delabie . | |
| 4,436,119 | 3/1984 | Shahan et al. . | |
| 4,467,610 | 8/1984 | Pearson et al. . | |
| 5,201,887 | 4/1993 | Bruchez, Jr. et al. | 60/725 |
| 5,361,578 | 11/1994 | Donlan | 60/742 |
| 5,370,427 | 12/1994 | Hoelle et al. | 285/301 |
| 5,497,809 | 3/1996 | Wolf . | |

*Primary Examiner*—Ted Kim
*Attorney, Agent, or Firm*—Monica G. Krasinski

[57] ABSTRACT

A vibration damper 38 for a fuel nozzle 24 having a central axis about which are disposed an inner 34 and outer 36 concentric fuel tubes. The damper includes a sleeve 40 and at least two legs 42, each leg having a radial portion extending from the sleeve and a resilient, longitudinally extending portion 46. The sleeve engages the inner tube while the longitudinally extending portions of the legs bear against the inner surface 37 of the outer tube to dampen vibrations between the concentric tubes. Besides damping objectionable vibratory forces experienced by the fuel tubes in the fuel nozzle, the present invention offers minimal fuel flow blockage in the concentric fuel tubes.

6 Claims, 2 Drawing Sheets

FIG.2
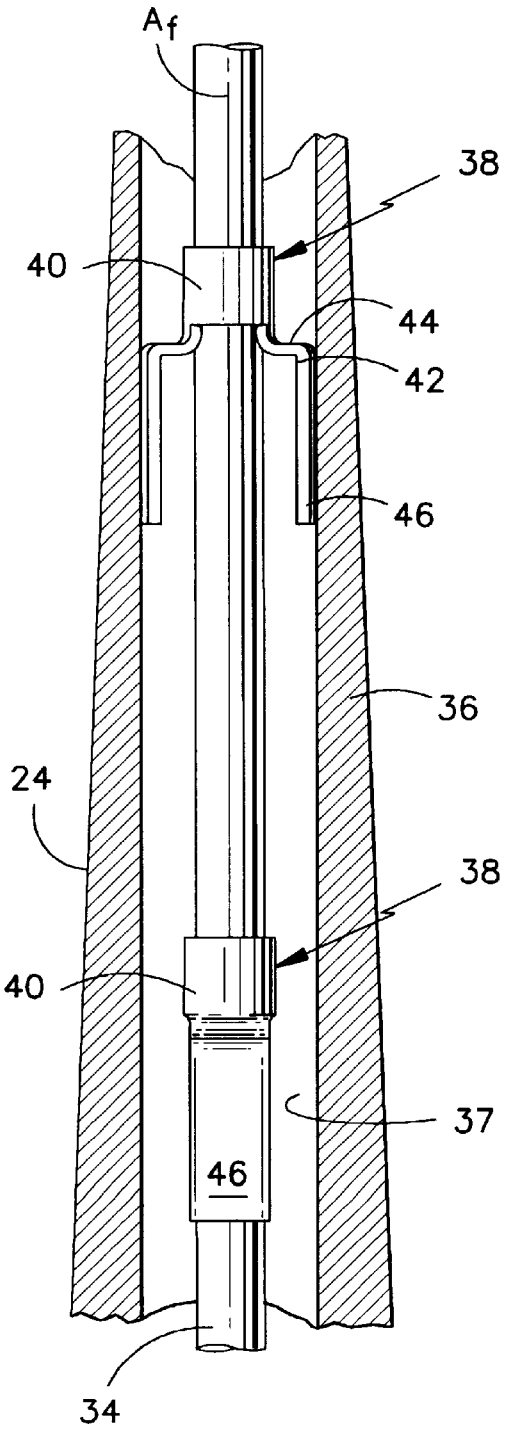
FIG.3
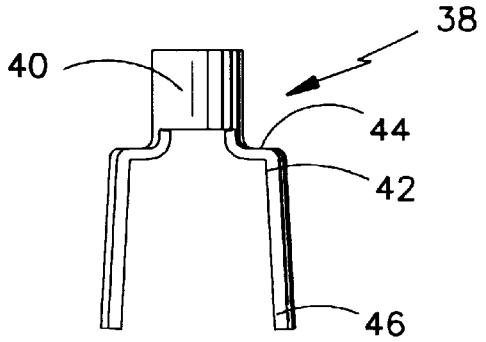
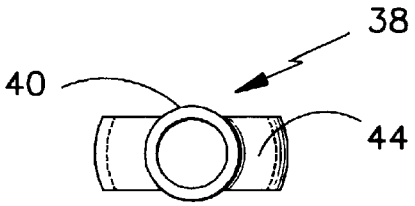
FIG.4
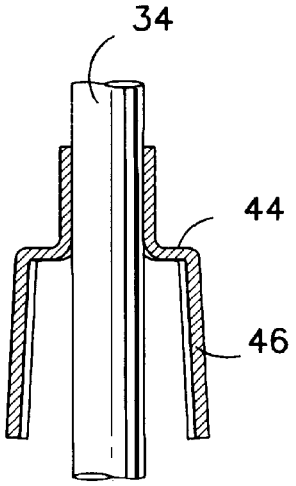
FIG.5

VIBRATION DAMPER FOR A FUEL NOZZLE OF A GAS TURBINE ENGINE

TECHNICAL FIELD

The present invention relates to gas turbine engines and more particularly to a vibration damper that limits vibrational effects between concentric tubes in a fuel nozzle.

BACKGROUND ART

A gas turbine engine combustor is typically disposed within an annular combustion section between an inner and an outer engine case wall. A plurality of primary fuel nozzles disposed in the upstream end of the combustor supply a mixture of fuel and air axially into the combustor at a closely controlled ratio. A plurality of secondary fuel nozzles are disposed in the outer engine case wall. The secondary fuel nozzles supply a mixture of fuel and air radially into the combustor during engine startup and at certain thrust levels. The secondary fuel nozzles are actuated during low and intermediate power regimes to stabilize the flame in the combustor.

Typically, the secondary fuel nozzles include a central axis about which are disposed an inner and an outer concentric fuel tubes. The inner tube carries liquid fuel while the outer tube carries fuel supplied as a gaseous fluid (natural gas fuel). The gaseous fuel in the outer tube thermally insulates the liquid fuel in the inner tube thereby preventing a problem of coking within the fuel nozzle. Coking is a thickening of any residual fuel that is stagnant within the fuel system passages. When stagnant fuel is heated, it solidifies and can reduce effective fuel flow capacity and actually plug the fuel supply system. The secondary fuel nozzles are particularly susceptible to coking because fuel tends to stagnate and get heated within the nozzle when the nozzle is not actuated during those thrust settings when only the primary nozzles are operating. Thus, insulating the inner tube carrying liquid fuel by the outer concentric tube, reduces the problem of coking.

However, the geometry of the inner and outer concentric tubes is not without problem. It will be appreciated that the environment within a gas turbine engine combustion chamber is extremely harsh. The fuel-air mixture burns in the combustion chamber at temperatures as high as 2100° C. (3800° F.) causing extreme thermal gradients and therefore, thermal stresses in the inner and outer engine case walls in the combustion section. Moreover, rotational movement of the engine's compressor and turbine, as well as the high flow rate of the fuel-air mixture and the burning thereof, may cause significant vibration and pressure pulsations in the combustion section and engine case walls. Such high thermal stresses and vibration experienced by the combustion section walls are also experienced by the secondary fuel nozzles. Prior art secondary fuel nozzles have, in large measure, failed to adequately tolerate such a harsh vibratory and thermal environment without themselves exhibiting vibratory movement. Such movement risks not only the misalignment of the fuel nozzles with other components in the combustor such as igniters, and the like, but also actual damage to the concentric fuel tubes of the nozzles due to relative vibratory movement between the inner and outer fuel tubes. The inner and outer fuel tubes may crack due to wear and fatigue caused by the vibratory stresses.

U.S. Pat. Nos. 3,785,407 to Waite et al. and 4,098,476 to Jutte et al. teach an apparatus for a spacer member between a pipe and a cover, and a support apparatus to prevent rotational and translational motion at certain temperatures respectively. While Waite et al. discloses a pipe cover spacer with yieldable fingers extending to make contact with a pipe, it is desirable to dampen vibrations between two tubes in an economical way. The yieldable fingers in Waite's disclosure are separate pieces arranged circumferentially to provide a spacing function. Further, while Jutte et al. discloses a support apparatus that fits loosely around the inner housing, this configuration would not be able to dampen low amplitude vibrations between two concentric tubes. In addition, the support apparatus is Jutte et al. is a circumferentially continuous ring, a configuration which would impede flow in the annulus of the outer tube. Thus, there is a need to provide an economical vibration damping system for two concentric tubes, while maintaining fuel flow in the outer tube.

DISCLOSURE OF THE INVENTION

According to the present invention, a fuel nozzle having a central axis, an inner and an outer concentric fuel tube disposed about the axis, a vibration damper having a sleeve and at least two legs, each leg having a longitudinally extending portion, the sleeve engaging the inner tube and the longitudinally extending portion of the legs bearing against the inner surface of the outer tube wherein the vibration damper dampens vibrational effects between the concentric fuel tubes during engine operation. The legs of the damper are L-shaped, with radially extending portions and resilient longitudinally extending portions.

In accordance with the present invention, one embodiment of the fuel nozzle includes two vibration dampers at spaced locations. The second damper is angularly offset from the first damper.

An advantage of the present invention is the durability and structural integrity of the fuel nozzles due to the vibration damper. The vibration damper appreciably reduces the intensity of vibratory forces experienced by the concentric tubes. The fuel tubes are thus not subject to wear and fatigue imposed by the vibration forces. Another advantage of the present invention is minimal fuel flow blockage in the annulus between the inner and outer tube. By angularly offsetting the dampers, the present invention distributes any blockage to the fuel flow in the outer tube. This decreases the pressure drop in the outer tube as compared with a configuration that has the dampers aligned. Further, the legs minimally block fuel flow because they are not circumferentially continuous.

The foregoing and other objects, features and advantages of the present invention will become more apparent in the following detailed description of the best mode for carrying out the invention and from the accompanying drawings which illustrate an embodiment of the invention.

BRIEF DESCRIPTION OF THE DRAWINGS

FIG. 2 is an enlarged, sectional view of the fuel nozzle of the present invention shown in FIG. 1.

FIG. 3 is a front view of the fuel nozzle vibration damper of the present invention.

FIG. 4 is a top view of the fuel nozzle vibration damper of the present invention.

FIG. 5 is a cross-sectional view of the fuel nozzle vibration damp of the present invention mounted on an inner fuel tube.

BEST MODE FOR CARRYING OUT THE INVENTION

Figure 1:
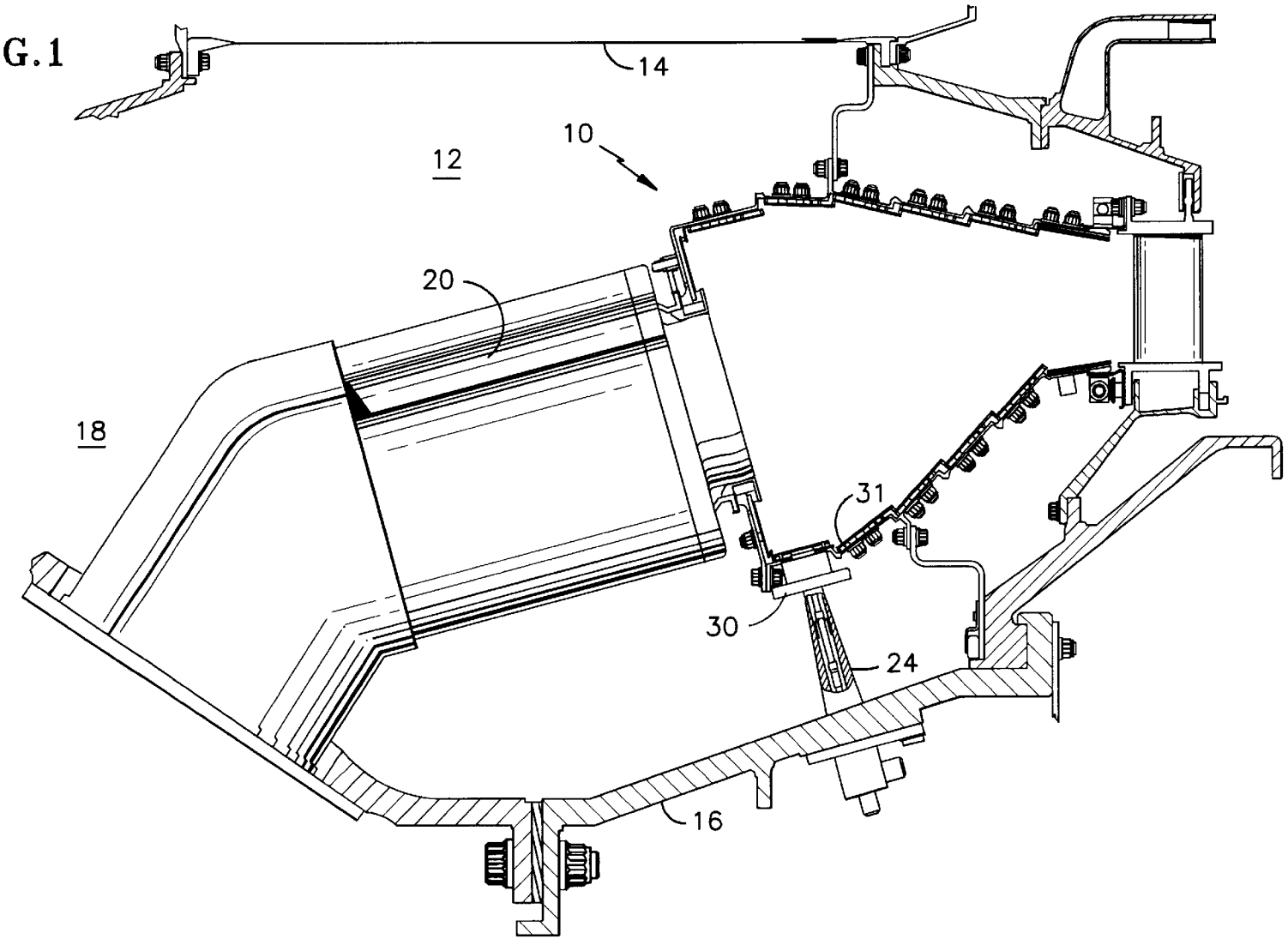
FIG. 1 is a schematic representation of a combustion section of a gas turbine engine with a secondary fuel nozzle attached to an outer engine case wall and extending through into a combustor wall.

Referring to FIG. 1, a combustor 10 is disposed within an annulus 12 between an inner engine case wall 14 and an outer engine case wall 16. A diffuser 18 leads axially into the annulus 12 from a compression section (not shown). A plurality of primary fuel nozzles 20 are spaced circumferentially within the annulus 12 to premix fuel with a portion of air exiting the diffuser 18 and to supply the fuel and air mixture to the combustor 10.

A plurality of secondary fuel nozzles 24 are spaced circumferentially within the annulus 12 to provide a fuel-air mixture radially into the combustor 10. Each secondary fuel nozzle 24 is fixedly attached to the outer engine case wall 16, and extends into the combustor 10 through an annular fuel nozzle guide 30. The fuel nozzle guide 30 is fixedly mounted onto a combustor wall 31.

Referring to FIGS. 2, 3, 4 and 5, the secondary fuel nozzle 24 has a central axis $A_f$ about which is disposed an inner fuel tube 34 which carries liquid fuel. The secondary fuel nozzle also includes an outer fuel tube 36 (in the preferred embodiment, an outer housing) disposed about the central axis and spaced radially outwardly from the inner fuel tube 34. The outer fuel tube has an inner surface 37, and carries gaseous fuel such as natural gas. Vibration dampers 38 are attached to the inner fuel tube 34. The damper 38 has an annular portion or sleeve 40 which may be brazed onto the inner fuel tube.

The vibration damper 38 includes at least two L-shaped legs 42. The legs have a radially extending portion 44 and a longitudinally extending portion 46. The longitudinally extending portion 46 is a spring and thus resilient.

In an embodiment of the present invention, a second vibration damper 38 is spaced longitudinally from a first damper 38 as shown in FIG. 2. The second damper 38 is angularly offset by ninety degrees (90°) from the first damper.

During the operation of the engine, the outer engine case 16 and the combustor 10 move relative to each other as a result of thermal cycling. The secondary fuel nozzles 24 experience vibratory movement as they are attached to the outer engine case and via the fuel nozzle guide 30, to the combustor wall 31. In turn, the inner fuel tube 34 and the outer fuel tube 36 experience vibratory forces as they too are structurally attached to the outer engine case and to the combustor wall which transmit the vibrational energy to the tubes. The inner tube, being unsupported in the fuel nozzle, is susceptible to vibrational damage and any resultant fatigue. The vibrational damper of the present invention dampens vibrations between the inner and outer tubes. The spring action of the damper 38, in particular that of the longitudinally extending portions 46, applies a constant force against the outer tube. This force not only maintains the concentricity of the inner and outer tubes, but also dampens vibrations between the two tubes. The diameter of the damper is sized closely to the diameter of the outer tube to maximize surface contact between the longitudinally extending portions 46 of the legs and the inner surface 37 of the outer tube 36. Thus, the fuel tubes are not subjected to wear and fatigue imposed by vibratory forces.

The vibration damper of the present invention also offers minimal fuel flow blockage in the annulus between the inner and outer fuel tubes. The legs of the damper are not circumferentially continuous to impede fuel flow. In addition, by longitudinally spacing the dampers in the fuel tubes and by angularly offsetting the legs, the present invention distributes any blockage to fuel flow in the outer tube, thus decreasing the pressure drop in the outer tube as compared with a configuration that has the dampers aligned. Thus, the vibration damper of the present invention offers a low cost, vibration damping mechanism with minimal impact to the flow of fuel in fuel nozzles.

Although the invention has been shown and described with respect to detailed embodiments thereof, it should be understood by those skilled in the art that various changes in form and detail thereof may be made without departing from the spirit and the scope of the claimed invention.

What is claimed is:

1. In a fuel injection nozzle for a gas turbine engine having a longitudinal axis, a first fuel tube, a second fuel tube having an inner surface, and positioned radially outwardly from said first tube, a vibration damper comprising:

a sleeve engaging one of the fuel tubes; and at least two legs, engaging the other of said fuel tubes, each leg having a radial portion extending from said sleeve and a resilient, longitudinally extending portion bearing against the inner surface of the other fuel tube to dampen vibrational effects between said first and second fuel tubes during engine operation.

2. The fuel injection nozzle of claim 1, wherein the radial and longitudinal portions of said legs are substantially perpendicular with respect to one another.

3. The fuel injection nozzle of claim 1, wherein a second vibration damper is spaced longitudinally and angularly offset from a first damper.

4. The fuel injection nozzle of claim 3, wherein the second damper is offset approximately ninety degrees from the first damper.

5. In a fuel injection nozzle for a gas turbine engine having a longitudinal axis, a first fuel tube carrying liquid fuel being centered about said axis, a second fuel tube carrying gaseous fuel and having an inner surface, said second fuel tube being centered about said axis and positioned radially outwardly from said first fuel tube, a vibration damper comprising:

a sleeve engaging the first fuel tube; and two legs engaging the second fuel tube, said legs having a radial portion extending from said sleeve and a resilient, longitudinally extending portion bearing against the inner surface of the second fuel tube to dampen vibrational effects between first and second fuel tubes during engine operation.

6. The fuel injection nozzle of claim 5, further comprising a second damper angularly offset by ninety degrees and spaced longitudinally from a first damper.

* * * * *